US006073341A

United States Patent [19]

Odorfer

[11] Patent Number: 6,073,341

[45] Date of Patent: Jun. 13, 2000

[54] DOME SWITCH ASSEMBLY SYSTEM

[76] Inventor: Richard A. Odorfer, 7607 N. Deerfield Dr., Prescott, Ariz. 86301

[21] Appl. No.: 09/038,268

[22] Filed: Mar. 10, 1998

[51] Int. Cl.[7] ..... H01H 69/02

[52] U.S. Cl. ..... 29/623; 29/622; 200/5 A; 200/5 B

[58] Field of Search ..... 29/622, 623, 430, 29/453, 773, 797, 740; 200/1, 5 A, 275, 159, 302

[56] References Cited

U.S. PATENT DOCUMENTS

| | | | |
|---|---|---|---|
| 3,988,551 | 10/1976 | Larson | 200/5 |
| 4,005,293 | 1/1977 | Boulanger | 200/5 |
| 4,085,306 | 4/1978 | Dunlap | 200/275 |
| 4,194,097 | 3/1980 | Bradam | 200/5 |
| 4,263,485 | 4/1981 | Corwin | 200/5 |
| 4,341,498 | 7/1982 | Ellis | 413/3 |
| 4,365,120 | 12/1982 | Pounds | 200/5 |
| 4,463,234 | 7/1984 | Bennewitz | 200/159 |
| 4,499,343 | 2/1985 | Prioux | 200/5 |
| 4,811,175 | 3/1989 | Desmet | 362/95 |
| 5,500,997 | 3/1996 | Kobayashi et al. | 29/740 |

*Primary Examiner*—Lee Young
*Assistant Examiner*—Sean P. Smith
*Attorney, Agent, or Firm*—Martin L. Stoneman

[57] ABSTRACT

A machine method for providing a dome switch sub-assembly used for providing a keyboard-type user input to electronic devices. A spacer layer, attached to a retaining layer, having a plurality of spacer layer openings for receiving a plurality of dome switches is placed upon a moveable machine table. The dome switches, arranged in reel form, are machine removed and placed into the spacer layer openings. A removable release liner is then attached to the spacer layer. Also a complete dome switch assembly is provided. A spacer layer, attached to a circuit board, having a plurality of dome switch openings is placed on a moveable machine table. The dome switches, arranged in reel form, are machine removed and placed into the spacer layer openings. A retaining cover is attached to the spacer layer. An overlay layer, attached to the retaining cover layer, may also be provided.

20 Claims, 5 Drawing Sheets

FIG. 10
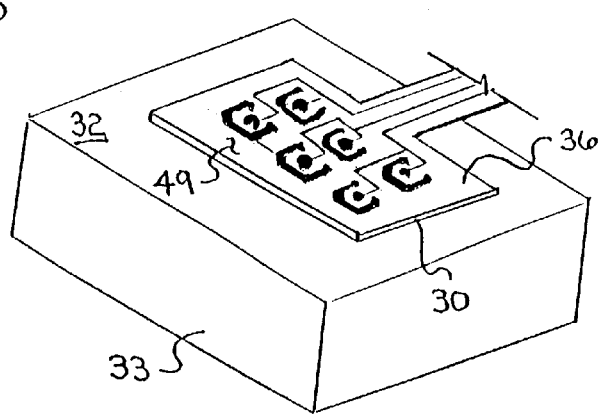
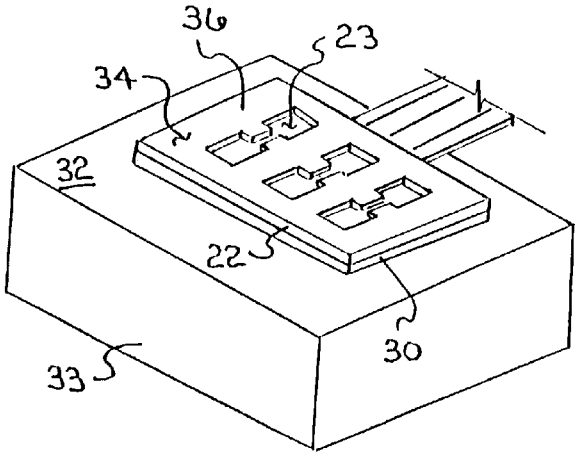
FIG. 11
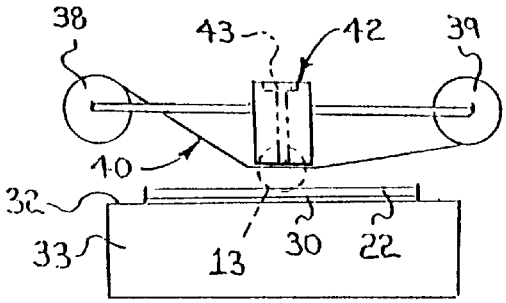
FIG. 12
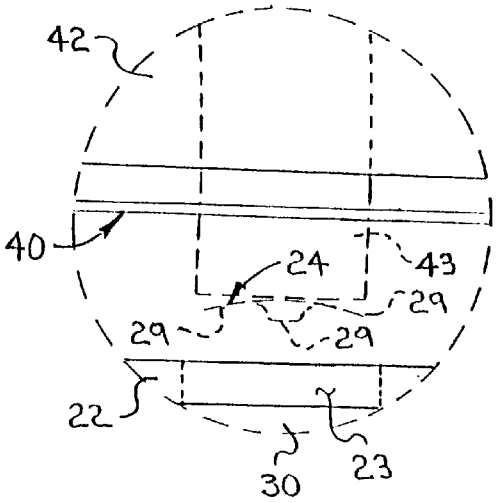
FIG. 13

DOME SWITCH ASSEMBLY SYSTEM

BACKGROUND OF THE INVENTION

1. Field of the Invention

This invention relates to a dome switch assembly system. More particularly, this invention concerns the manufacture of a dome switch sub-assembly having a retaining cover, a spacer layer encompassing a plurality of dome switches, and a release liner. Even further, this invention concerns the manufacture of a complete dome switch assembly having a circuit board, spacer layer encompassing a plurality of dome switches, a retaining cover layer, and an overlay layer.

2. Description of the Prior Art

Typically, dome switch assemblies or tactile dome switch arrays are utilized to allow a user to manually input data into an electrical device. Generally, such tactile arrays are in the form of a keyboard or touchpad having certain alpha, numerical, or other designations corresponding to a particular area on the tactile array. Upon the user manually pressing these particular areas, dome switches in the array are pressed against a circuit board, thereby allowing an electrical signal to pass and thus be acted upon by the internal processing system of the electrical device.

Generally, dome switch assemblies consist of the following layers: a circuit board layer, a spacer layer, metal domes, a retaining cover layer, and an overlay layer. Typically, each dome switch assembly is individually assembled by hand, resulting in increased manufacturing costs due to the required manual labor. It is also well known in the art to provide dome switches which are sandwiched between a retaining cover and a release liner wherein the domes are situated on the retaining cover according to the configuration of the circuit board as provided by the customer. A common problem with this method is that the domes tend to migrate in the space between the retaining cover and the release liner, resulting in delays and increased cost to manually reposition the dome switches so as to conform to the circuit board layout. Thus there exists a need for a dome switch system that can be automatically assembled and which will solve the problems encountered by the prior art.

OBJECTS OF THE INVENTION

A primary object of the present invention is to fulfill the above-mentioned needs by the provision of an automatic machine method to assemble either sub-portions or all of a dome switch assembly. A further primary object of the present invention is to provide such a dome switch system that is efficient, inexpensive, and handy. Other objects of this invention will become apparent with reference to the following invention description.

SUMMARY OF THE INVENTION

According to a preferred embodiment of the present invention, this invention provides a machine method for providing, for dome switches of the type wherein each dome switch comprises an approximately hemispherical top surface having an apex, a dome switch sub-assembly having a retaining cover layer, a spacer layer having a plurality of openings for respectively receiving a plurality of dome switches, and a release liner, comprising the steps of: positioning on a machine table having a machine-movable surface an initial assembly comprising such retaining cover layer, having a retaining cover top surface, and adjacent such retaining cover top surface, such spacer layer, having a spacer layer top surface; situating such dome switches, affixed in a dome switch reel, over such machine-movable surface of such machine table; machine-blanking respective such dome switches into respective such openings of such spacer layer; and placing such release liner on such spacer layer top surface.

In addition, this invention provides such a machine method wherein such retaining cover layer of such initial assembly is adhesively attached to such spacer layer. And it provides such a machine method wherein such placing of such release liner on such spacer layer comprises adhesively bonding such release liner to such spacer layer. Also it provides such a machine method wherein each substep of such machine-blanking step comprises: moving such machine-movable table in such manner that it locates for machine dome switch placement an unfilled such opening not having therein a such dome switch; and machine-placing a such dome switch into such unfilled opening. It further provides such a machine method wherein such dome switch reel is structured and arranged in such manner that such dome switches are blanked into such spacer layer openings with such apex of such dome switch facing down; and, further, wherein such positioning step and such placing step are both manually accomplished.

Moreover, this invention provides such a machine method wherein each substep of such machine-blanking step comprises: moving such machine-movable table in such manner that it locates for machine dome switch placement an unfilled such opening not having therein a such dome switch; and machine-placing a such dome switch into such unfilled opening; and such dome switch reel is structured and arranged in such manner that such dome switches are blanked into such spacer layer openings with such apex of such dome switch facing down. And it provides such a machine method wherein such retaining cover layer of such initial assembly is adhesively attached to such spacer layer; and such placing of such release liner on such spacer layer comprises adhesively bonding such release liner to such spacer layer.

Even further, in accordance with a preferred embodiment thereof, the present invention provides a machine method for providing, for dome switches of the type wherein each dome switch comprises an approximately hemispherical top surface having an apex, a dome switch assembly having a circuit layer, a retaining cover layer, a spacer layer having a plurality of openings for respectively receiving a plurality of dome switches, and a release liner, comprising the steps of: positioning on a machine table having a machine-movable surface an initial assembly comprising such circuit layer, circuit side upwards, and adjacent such circuit side of such circuit layer, such spacer layer, having a spacer layer top surface; situating such dome switches, affixed in a dome switch reel, over such machine-movable surface of such machine table; machine-blanking respective such dome switches into respective such openings of such spacer layer; and placing such retaining cover layer, having a retaining cover top surface, on such spacer layer top surface.

Yet additionally, this invention provides such a machine method further comprising a last step of placing an overlay layer, having an icon side, with such icon side upwards, on such retaining cover top surface. And it provides such a machine method wherein such retaining cover layer of such initial assembly is adhesively attached to such spacer layer. Also, it provides such a machine method wherein such placing of such spacer layer on such circuit layer adhesively bonds such circuit layer to such spacer layer.

Moreover, this invention provides such a machine method wherein each substep of such machine-blanking step comprises: moving such machine-movable table in such manner that it locates for machine dome switch placement an unfilled such opening not having therein a such dome switch; and machine-placing a such dome switch into such unfilled opening. Further, it provides such a machine method wherein such dome switch reel is structured and arranged in such manner that such dome switches are blanked into such spacer layer openings with such apex of such dome switch facing up.

Yet in addition, this invention provides a machine method wherein each substep of such machine-blanking step comprises moving such machine-movable table in such manner that it locates for machine dome switch placement an unfilled such opening not having therein a such dome switch; and machine-placing a such dome switch into such unfilled opening; and such dome switch reel is structured and arranged in such manner that such dome switches are blanked into such spacer layer openings with such apex of such dome switch facing up. It further provides such a machine method wherein such retaining cover layer of such initial assembly is adhesively attached to such spacer layer; and such placing of such spacer layer on such circuit layer comprises adhesively bonding such circuit layer to such spacer layer.

Even further, in accordance with a preferred embodiment thereof, the present invention provides a machine method for providing, for dome switches of the type wherein each dome switch comprises an approximately hemispherical top surface having an apex, a complete dome switch assembly having a circuit layer, a retaining cover layer, a spacer layer having a plurality of openings for respectively receiving a plurality of dome switches, a release liner, and an overlay layer, comprising the steps of: positioning on a machine table having a machine-movable surface an initial assembly comprising such circuit layer, circuit side upwards, and adjacent such circuit side of such circuit layer, such spacer layer, having a spacer layer top surface; situating such dome switches, affixed in a dome switch reel, over such machine-movable surface of such machine table; machine-blanking respective such dome switches into respective such openings of such spacer layer; placing such retaining cover layer, having a retaining cover top surface, on such spacer layer top surface; and placing such overlay layer, having an icon side, with such icon side upwards, on such retaining cover top surface; thereby making a complete dome switch assembly.

Also, it provides such a machine method wherein each substep of such machine-blanking step comprises: moving such machine-movable table in such manner that it locates for machine dome switch placement an unfilled such opening not having therein a such dome switch; and machine-placing a such dome switch into such unfilled opening; and such dome switch reel is structured and arranged in such manner that such dome switches are blanked into such spacer layer openings with such apex of such dome switch facing up. Even further, it provides such a a machine method wherein such retaining cover layer of such initial assembly is adhesively attached to such spacer layer; and such placing of such spacer layer on such circuit layer comprises adhesively bonding such circuit layer to such spacer layer.

Yet further still, in accordance with a preferred embodiment thereof, the present invention provides, in a machine method for blanking dome switches off a dome-switch feed reel to place a respective such dome switch into an opening in a spacer layer situated on a machine table having a machine-movable surface, the step of reversing such dome switch input reel to present each such dome switch for blanking in a position to place each such dome switch in such spacer layer in an upside down position.

BRIEF DESCRIPTION OF THE DRAWINGS

FIG. 10 is a perspective view illustrating the placement of the circuit board on the x-y table according to the embodiment shown in FIG. 9.

FIG. 11 is a perspective view illustrating the placement of the spacer layer on the circuit board according to the embodiment shown in FIG. 9.

FIG. 12 is an elevation view illustrating the step of blanking the dome switches into the spacer layer openings according to the embodiment shown in FIG. 9.

FIG. 13 is a partial enlarged view, in elevation, taken from FIG. 12, illustrating the blanking of dome switches according to the embodiment shown in FIG. 9.

DETAILED DESCRIPTION OF A PREFERRED EMBODIMENT AND THE BEST MODE OF PRACTICE

Figure 1:
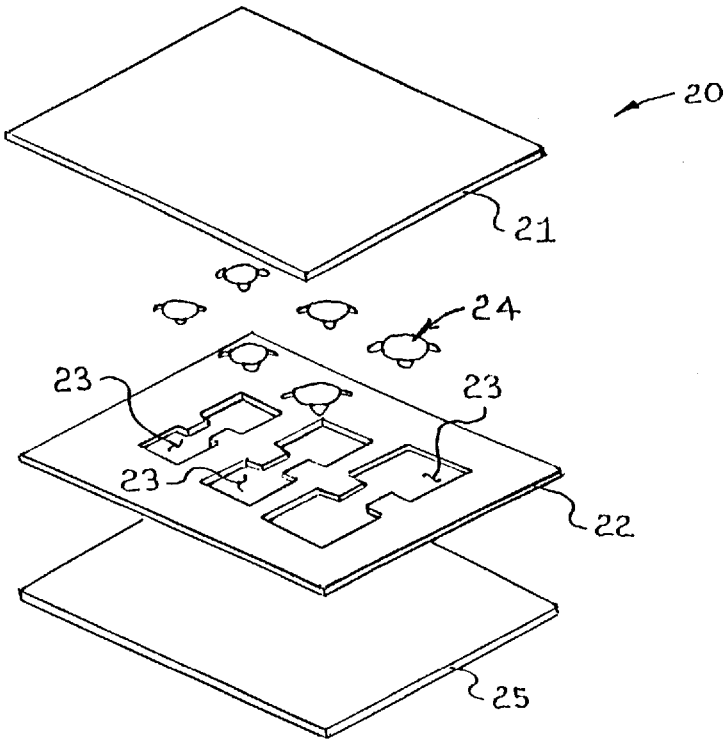
FIG. 1 is an exploded perspective view illustrating the layers comprising the dome switch sub-assembly according to a preferred embodiment of the present invention.
Figure 2:
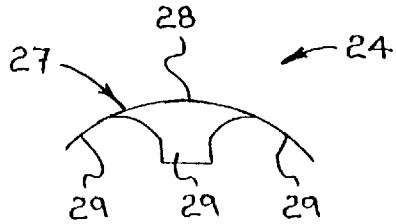
FIG. 2 illustrates a typical dome switch as used in the present invention.

FIG. 1 illustrates the dome switch sub-assembly 20 of the present invention according to a preferred embodiment thereof. Shown is a dome switch sub-assembly 20 consisting of a retaining cover layer 21, a spacer layer 22 having a plurality of spacer layer openings 23 for receiving a plurality of dome switches 24, and a release liner layer 25. The dome switches 24 are sized according to customer size specifications and are manufactured, in well known ways, from approximately 0.09 mm thick stainless steel. In the present invention, FIG. 2 illustrates that the dome switches 24 may be exemplified by a hemispherical surface 27 having an apex 28 at its uppermost portion. Contact tabs 29 are provided along the base of the hemispherical surface 27 for providing an electrical contact with a circuit board 30 (not shown in FIG. 2). Though applicant has described the dome switch 24 according to the best embodiment, it should be apparent to those skilled in the art that other shapes, sizes, and configurations of dome switches may be used without deviating from the spirit of the present invention.

Figure 3:
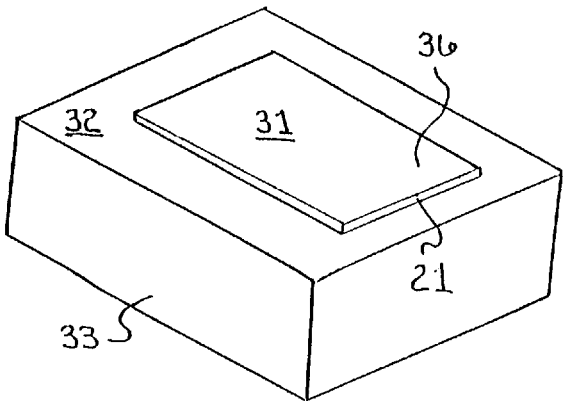
FIG. 3 is a perspective view illustrating the placement of a retaining cover on an x-y table of an automatic machine.
Figure 4:
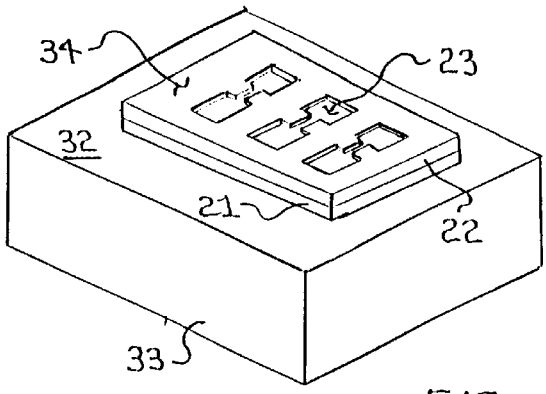
FIG. 4 is a perspective view illustrating the placement of a spacer layer on top of the retaining cover.

Illustrated in FIGS. 3–8 are the preferred sequence of steps to be performed in manufacturing the dome switch sub-assembly 20 of the present invention. Though the figures illustrating the present invention, and all embodiments hereof, show approximately rectangular shapes for the individual layers, it should be understood that other geometrical shapes may be used for the individual layers without deviating from the spirit of the present invention. As illustrated in FIG. 3, the first step consists of manually placing the retaining cover layer 21, having a retaining cover top surface 31 and preferably made of approximately 0.002-inch-thick polyester material, on the working surface 32 of a typical x-y table 33, part of a typical automatic blanking system (which includes the blanking station 42 and reels 38 and 39 illustrated in FIG. 4). Proper positioning of the retaining cover layer 21 on the working surface 32 is achieved in a manner readily apparent to one skilled in the art of such x-y tables. After the retaining cover layer 21 is properly positioned, the spacer layer 22, having a spacer layer top surface 34, is adhesively affixed, preferably manually, on the retaining cover top surface 31, as shown in FIG. 4. The spacer layer is preferably made of a polyester material having a thickness ranging from 0.002 inch to 0.013 inch with a typical thickness of 0.007 inch. To secure the spacer layer 22 to the retaining cover layer 21, a coat of adhesive material 36, preferably comprising a typical high temperature acrylic adhesive, is applied between the two layers (as shown in FIG. 3).

Figure 5:
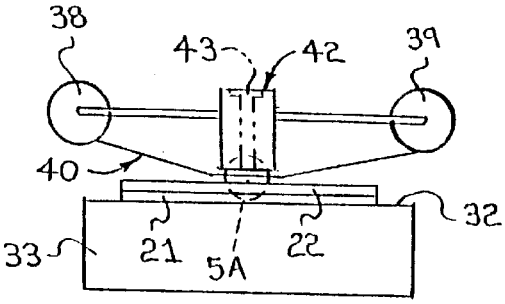
FIG. 5 is an elevation view illustrating the step of blanking the dome switches into the spacer layer spaces.
Figure 6:
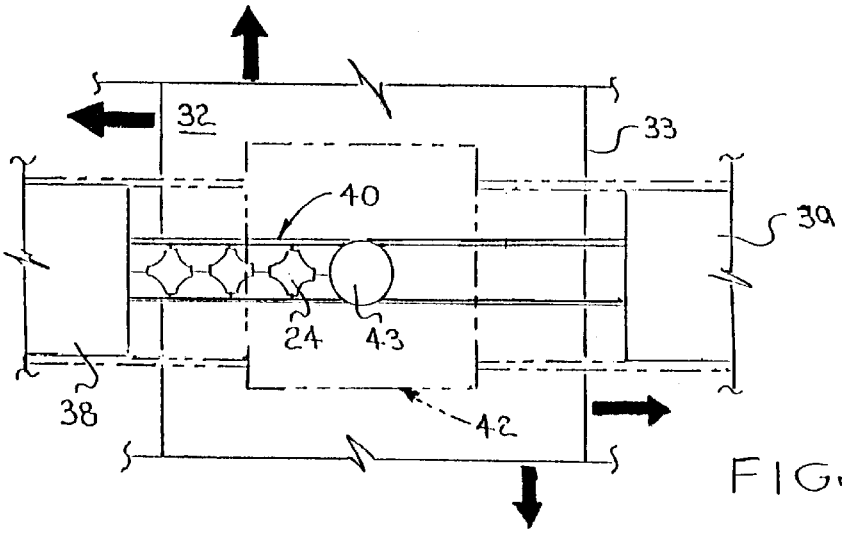
FIG. 6 is a partial top view of FIG. 5 (with the blanking station shown in phantom detail for clarity) illustrating the dome switches, in reel form, being blanked from the stamped sheet.

FIG. 5 illustrates the next step in the manufacture of the dome switch sub-assembly 20. Specifically illustrated is the retaining cover layer 21 and spacer layer 22 placed on the working surface 32 of the x-y table 33. Positioned above the x-y table 33 are an input reel 38 and an output reel 39. Typically, the dome switches 24 are formed on a sheet of raw material in well known ways such as stamping. After the step of forming of the dome switches 24 is complete, the stamped sheet 40 containing the formed dome switches 24 is spooled onto an input reel 38 thereby placing the dome switches in "reel form". As shown in FIGS. 5–6, the stamped sheet 40 is then passed through a typical blanking station 42 which is positioned above the working surface 32 of the x-y table 33. In operation, as the stamped sheet 40 passes through the blanking station 42, an air actuated blanking die 43 separates the dome switches 24 from the stamped sheet 40, thereby allowing the dome switches 24 to drop into the spacer layer openings 23.

Figure 5A:
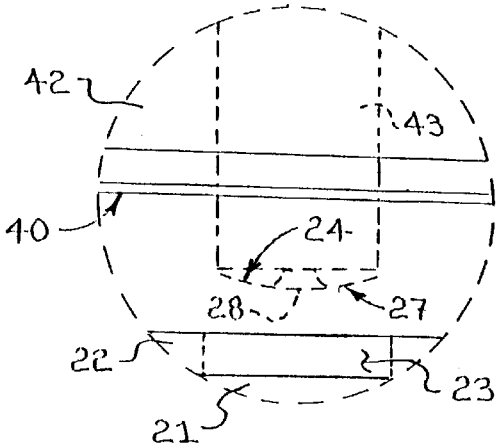
FIG. 5A is a partial enlarged view, in elevation, taken from FIG. 5, illustrating the blanking of dome switches according to the embodiment shown in FIG. 1.

As shown in alternate enlarged detail in FIG. 5A, the input reel 38 is structured and arranged so that the hemispherical top surface 27 of the dome switches 24 faces toward the x-y table 33. This step embodies herein a machine method wherein such dome switch input reel is structured and arranged in such manner that such dome switches are blanked into such spacer layer openings with such apex of such dome switch facing down. In accordance with this arrangement, when the blanking die 43 removes or blanks the dome switches 24 from the stamped sheet 40 and places them into the spacer layer openings 23, the apex 28 of dome switch hemispherical top surface 27 rests on the retaining cover layer 21 as seen best in FIG. 8. Correct placement of the dome switches 24 into the individual spacer layer openings 23 is accomplished by a typical x-y table 33 which is structured and arranged to laterally move, according to a pre-programmed computer algorithm, the working surface of the x-y table 32 in either the x or y direction as indicated by the directional arrows in FIG. 6. The use of the x-y table 33 thus allows for automatic positioning of the correct spacer layer openings 23 under the blanking die 43. This step embodies herein a machine method wherein each substep of such machine-blanking step comprises moving such machine-movable table in such manner that it locates for machine dome switch placement an unfilled such opening not having therein a such dome switch; and machine-placing a such dome switch into such unfilled opening. Any scrap material remaining after the blanking process is then spooled onto the output reel 39. Specifically illustrated in FIG. 6 is a top view of the area of the blanking station 42 (with a portion of the blanking station 42 shown in phantom detail for clarity) illustrated and described with respect to FIG. 5.

Figure 7:
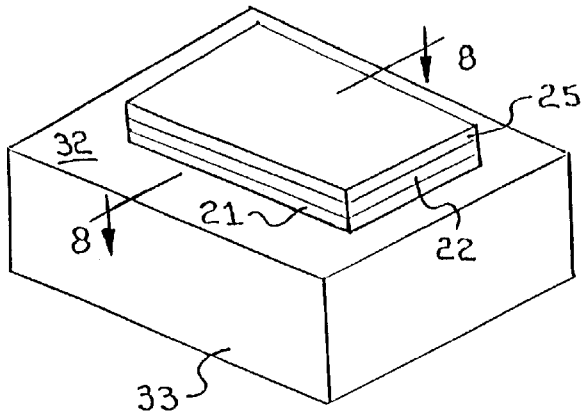
FIG. 7 is a perspective view illustrating the step of placing the release liner on top of the spacer layer.

FIG. 7 illustrates the final step in the assembly of the dome switch sub-assembly 20. This final step consists of placing, preferably manually, a release liner layer 25, preferably made of a paper material, over the spacer layer top surface 34, thereby preventing the dome switches 24 from being displaced from the spacer layer openings 23 prior to customer receipt. In applicant's preferred embodiment, the release liner layer 25 has a removable paper backing which, when removed, exposes a surface having an adhesive coat 25*a* (see FIG. 8). This surface is then placed on the spacer layer top surface 34, thereby securing the dome switches 24 inside their respective spacer layer openings 23. This step embodies herein a machine method wherein such placing of such release liner on such spacer layer comprises adhesively bonding such release liner to such spacer layer. Upon receipt by the customer of the dome switch sub-assembly 20, the customer simply peels the release liner 25 off of the spacer layer 22, and attaches the dome switch sub-assembly 20 to a circuit board 30 (not shown in FIG. 7).

Figure 8:
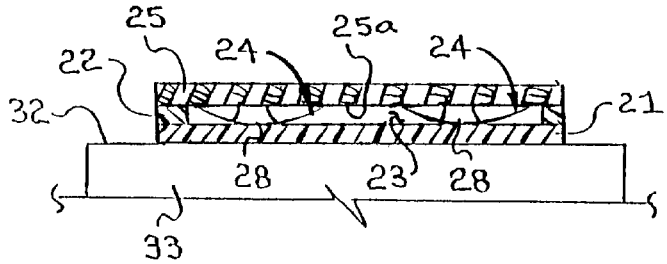
FIG. 8 is a partial section view, taken along lines 8—8 of FIG. 7 illustrating the individual layers comprising the dome switch sub-assembly.

FIG. 8 is a partial sectional view, taken along lines 8—8 of FIG. 7, which shows the individual layers comprising the assembled dome switch sub-assembly 20. Specifically illustrated is a retaining cover layer 21 adhesively attached to a spacer layer 22, as discussed. The spacer layer 22 is provided with a plurality of spacer layer openings 23 sized to fit a plurality of dome switches 24 of various sizes and shapes, as shown. To ensure that dome switches 24 are not displaced from their respective spacer layer openings 23, a removable release liner 25 is adhesively attached, as shown and as previously discussed, to the top surface of spacer layer 22, as shown in the figures.

According to a preferred embodiment of the present invention, the hereinbefore mentioned steps embody a machine method for providing, for dome switches of the type wherein each dome switch comprises an approximately hemispherical top surface having an apex, a dome switch sub-assembly having a retaining cover layer, a spacer layer having a plurality of openings for respectively receiving a plurality of dome switches, and a release liner, comprising the steps of: positioning on a machine table having a machine-movable surface an initial assembly comprising such retaining cover layer, having a retaining cover top surface, and adjacent such retaining cover top surface, such spacer layer, having a spacer layer top surface; situating such dome switches, affixed in a dome switch input reel, over such machine-movable surface of such machine table; machine-blanking respective such dome switches into respective such openings of such spacer layer; and placing such release liner on such spacer layer top surface.

Figure 9:
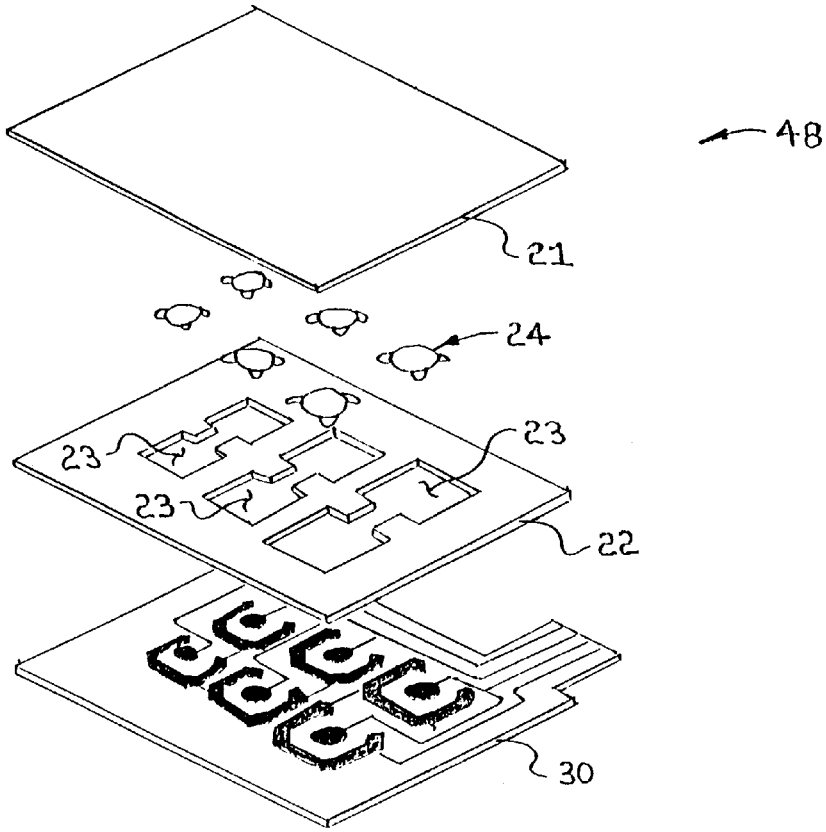
FIG. 9 is an exploded perspective view illustrating the layers comprising the complete dome switch assembly according to another preferred embodiment of the present invention.

According to an another preferred embodiment of the present invention, a complete dome switch assembly 48 is provided as shown in FIG. 9. Shown is a complete dome switch assembly 48 comprising the following elements: a retaining cover layer 21; a spacer layer 22 having a plurality of openings 23 to receive a plurality of dome switches 24; and a circuit board 30 used to provide the electronic connection between the dome switches 24 and internal electronics.

FIGS. 10–15 illustrate the preferred sequence of steps to be performed in manufacturing the complete dome switch assembly 48 of the present invention. As shown in FIG. 10, the first step consists of manually placing the circuit board 30, having a circuit board top surface 49, on the working surface 32 of a typical x-y table 33. After the circuit board 30 is properly positioned, a coat of adhesive material 36, preferably a high temperature acrylic adhesive, is applied to the circuit board top surface 49. Next, a spacer layer 22, having a spacer layer top surface 34, is adhesively affixed in the manner previously discussed, preferably manually, to the circuit board top surface 49, as shown in FIG. 11. This step embodies herein a machine method wherein such placing of such spacer layer on such circuit layer adhesively bonds such circuit layer to such spacer layer. The spacer layer 22 is oriented on the x-y table such as to allow accurate and correct placement of the dome switches 24 into the spacer layer openings 23 as will be more fully explained with reference to FIG. 12.

FIG. 12 illustrates the step of blanking the pre-formed dome switches 24 into the spacer layer openings 23. According to the preferred embodiment, the input reel 38 is structured and arranged so that the hemispherical top surface 27 of the dome switches 24 faces away from the x-y table 33 (as best shown in enlarged alternate detail in FIG. 13). This step embodies herein a machine method wherein such dome switch input reel is structured and arranged in such manner that such dome switches are blanked into such spacer layer openings with such apex of such dome switch facing up. And further, this step embodies in a machine method for blanking dome switches off a dome-switch input reel to place a respective such dome switch into an opening in a spacer layer situated on a machine table having a machine-movable surface, the step of reversing such dome switch input reel to present each such dome switch for blanking in a position to place each such dome switch in such spacer layer in an upside down position. The stamped sheet 40 passes under the blanking die 43 which removes or blanks the dome switches 24 from the stamped sheet 40. As illustrated in FIG. 13, the input reel 38 is structured and arranged so that the dome switches 24 are blanked into the spacer layer openings 23 so that the contact tabs 29 are at rest on the circuit board 30. Correct placement of the dome switches 24 into the individual spacer layer openings 23 is accomplished by a typical x-y table 33 which is structured and arranged to laterally move, according to a pre-programmed computer algorithm, the working surface of the x-y table 32 in either the x and/or y direction as indicated by the directional arrows in FIG. 6. The use of the x-y table 33 thus allows for automatic positioning of the correct spacer layer openings 23 under the blanking die 43. This step embodies herein a machine method wherein each substep of such machine-blanking step comprises moving such machine-movable table in such manner that it locates for machine dome switch placement an unfilled such opening not having therein a such dome switch; and machine-placing a such dome switch into such unfilled opening. Any scrap material remaining after the blanking process is then spooled onto the output reel 39.

Figure 14:
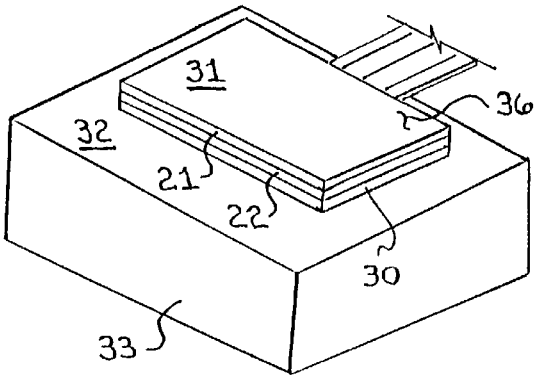
FIG. 14 is a perspective view illustrating the placement of the retaining cover on the spacer layer according to the embodiment shown in FIG. 9.
Figure 15:
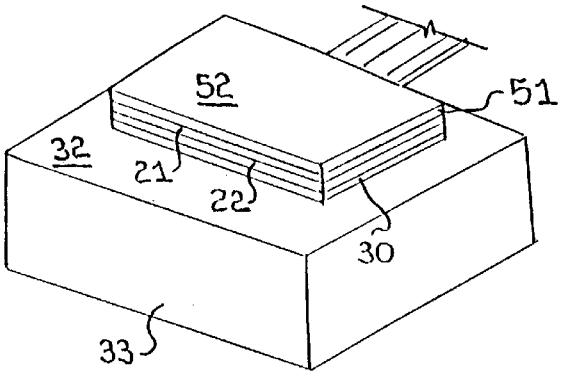
FIG. 15 is a perspective view of yet another preferred embodiment illustrating the placement of the overlay layer on the retaining cover.

As shown in FIG. 14, the last step in the assembly of the complete dome switch assembly 48 consists of first applying a coat of adhesive material 36, preferably a high temperature acrylic adhesive, to the spacer layer top surface 34 (as shown in FIG. 11). A retaining cover layer 21 is then adhesively affixed, preferably manually, to the spacer layer top surface 34, thereby securing the dome switches 24 within spacer layer openings 23. According to yet another preferred embodiment of the present invention, an overlay layer 51 having an icon side 52 on which is imprinted alpha, numeric, or other icons representing the various electronic functions or designations may be provided as shown in FIG. 15. The overlay layer 51 is typically made of a polyester material and has an approximate thickness of 0.007 inch. Incorporating the overlay layer 51 into the complete dome switch assembly 48 consists of applying a coat of adhesive material 36, preferably a high temperature acrylic adhesive, to the retaining cover top surface 31 (as shown in FIG. 14). The overlay layer 51 is then adhesively affixed, preferably manually, to the retaining cover top surface 31 so that the icon side 52 faces upward. This step embodies herein a machine method further comprising a last step of placing an overlay layer, having an icon side, with such icon side upwards, on such retaining cover top surface.

Figure 16:
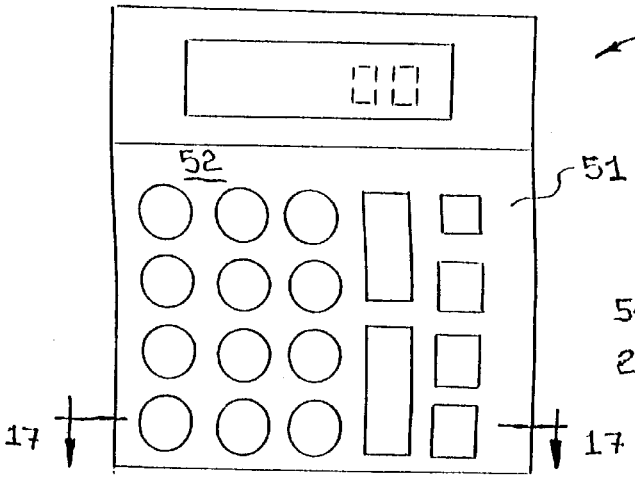
FIG. 16 is a top view of an electronic calculator incorporating the embodiments of the present invention.
Figure 17:
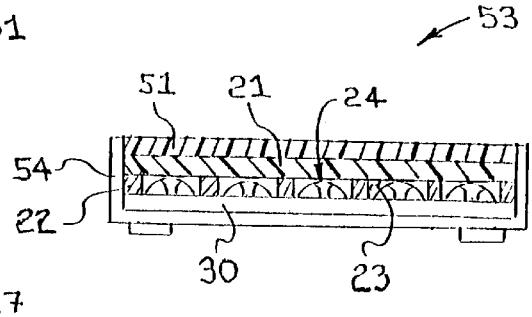
FIG. 17 is a sectional view taken along the section 17—17 of FIG. 16, illustrating the arrangement of the individual layers of the present invention installed in an electronic calculator illustrated in FIG. 16.

FIG. 16 is a representational illustration of the dome switch sub-assembly 20 and the complete dome switch assembly 48 installed in an end product. Specifically illustrated is an electronic calculator 53 having a dome switch-type keyboard or overlay layer 51. Shown in FIG. 17 is a section of the electronic calculator 53 specifically illustrating the individual layers comprising the dome switch sub-assembly 20 and the complete dome switch assembly 48 enclosed by the calculator housing 54. Shown are an overlay layer 51; a retaining cover layer 21; a spacer layer 22 having a plurality of openings 23 to receive a plurality of dome switches 24; and a circuit board 30 used to provide the electronic connection between the dome switches 24 and internal electronics.

In the present invention, the steps illustrated and described with respect to FIGS. 10–15 embody herein a machine method for providing, for dome switches of the type wherein each dome switch comprises an approximately hemispherical top surface having an apex, a complete dome switch assembly having a circuit layer, a retaining cover layer, a spacer layer having a plurality of openings for respectively receiving a plurality of dome switches, a release liner, and an overlay layer, comprising the steps of: positioning on a machine table having a machine-movable surface an initial assembly comprising such circuit layer, circuit side upwards, and adjacent such circuit side of such circuit layer, such spacer layer, having a spacer layer top surface; situating such dome switches, affixed in a dome switch input reel, over such machine-movable surface of such machine table; machine-blanking respective such dome switches into respective such openings of such spacer layer; placing such retaining cover layer, having a retaining cover top surface, on such spacer layer top surface; and placing such overlay layer, having an icon side, with such icon side upwards, on such retaining cover top surface; thereby making a complete dome switch assembly.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. A machine method for providing, for dome switches of the type wherein each dome switch comprises an approximately hemispherical top surface having an apex, a dome switch sub-assembly having a retaining cover layer, a spacer layer having a plurality of openings for respectively receiving a plurality of dome switches, and a release liner, comprising the steps of:

a. positioning on a machine table having a machine-movable surface an initial assembly comprising
   i. said retaining cover layer, having a retaining cover top surface, and
   ii. adjacent said retaining cover top surface, said spacer layer, having a spacer layer top surface;

b. situating said dome switches, affixed in a dome switch input reel, over said machine-movable surface of said machine table;

c. machine-blanking respective said dome switches from said dome switch input reel so that said dome switches drop into respective said openings of said spacer layer; and d. placing said release liner on said spacer layer top surface;

e. wherein said machine-movable surface is structured and arranged for lateral movement in orthogonal directions.

2. A machine method according to claim 1 wherein said retaining cover layer of said initial assembly is adhesively attached to said spacer layer.

3. A machine method according to claim 1 wherein said placing of said release liner on said spacer layer comprises adhesively bonding said release liner to said spacer layer.

4. A machine method according to claim 1 wherein each substep of said machine-blanking step comprises:

a. moving said machine-movable table in such manner that said machine-movable table locates for machine dome switch placement an unfilled said opening not having therein a said dome switch; and b. machine-blanking a said dome switch in such manner as to allow said dome switch to drop into said unfilled opening.

5. A machine method according to claim 1 wherein said dome switch input reel is structured and arranged in such manner that when said dome switches are blanked, said dome switches drop into said spacer layer openings with said apex of said dome switch facing down.

6. A machine method according to claim 1 wherein said positioning step and said placing step are both manually accomplished.

7. A machine method according to claim 1 wherein:

a. each substep of said machine-blanking step comprises
   i. moving said machine-movable table in such manner that said machine-movable table locates for machine dome switch placement an unfilled said opening not having therein a said dome switch; and
   ii. machine-blanking a said dome switch in such manner as to allow said dome switch to drop into said unfilled opening; and b. said dome switch input reel is structured and arranged in such manner that when said dome switches are blanked, said dome switches drop into said spacer layer openings with said apex of said dome switch facing down.

8. A machine method according to claim 7 wherein:

a. said retaining cover layer of said initial assembly is adhesively attached to said spacer layer; and b. said placing of said release liner on said spacer layer comprises adhesively bonding said release liner to said spacer layer.

9. A machine method for providing, for dome switches of the type wherein each dome switch comprises an approximately hemispherical top surface having an apex, a dome switch assembly having a circuit layer, a retaining cover layer, a spacer layer having a plurality of openings for respectively receiving a plurality of dome switches, and a release liner, comprising the steps of:

a. positioning on a machine table having a machine-movable surface an initial assembly comprising
   i. said circuit layer, circuit side upwards, and
   ii. adjacent said circuit side of said circuit layer, said spacer layer, having a spacer layer top surface;

b. situating said dome switches, affixed in a dome switch input reel, over said machine-movable surface of said machine table;

c. machine-blanking respective said dome switches from said dome switch input reel so that said dome switches drop into respective said openings of said spacer layer; and d. placing said retaining cover layer, having a retaining cover top surface, on said spacer layer top surface;

e. wherein said machine-movable surface is structured and arranged for lateral movement in orthogonal directions.

10. A machine method according to claim 9, further comprising a last step of placing an overlay layer, having an icon side, with said icon side upwards, on said retaining cover top surface.

11. A machine method according to claim 9 wherein said retaining cover layer of said initial assembly is adhesively attached to said spacer layer.

12. A machine method according to claim 9 wherein said placing of said spacer layer on said circuit layer adhesively bonds said circuit layer to said spacer layer.

13. A machine method according to claim 9 wherein each substep of said machine-blanking step comprises:

a. moving said machine-movable table in such manner that said machine-movable table locates for machine dome switch placement an unfilled said opening not having therein a said dome switch; and b. machine-blanking a said dome switch in such manner as to allow said dome switch to drop into said unfilled opening.

14. A machine method according to claim 9 wherein said dome switch input reel is structured and arranged in such manner that when said dome switches are blanked, said dome switches drop into said spacer layer openings with said apex of said done switch facing up.

15. A machine method according to claim 9 wherein:

a. each substep of said machine-blanking step comprises
   i. moving said machine-movable table in such manner that said machine-movable table locates for machine dome switch placement an unfilled said opening not having therein a said dome switch; and ii. machine-blanking a said dome switch in such manner as to allow said dome switch to drop into said unfilled opening; and b. said dome switch input reel is structured and arranged in such manner that when said dome switches are blanked, said dome switches drop into said spacer layer openings with said apex of said dome switch facing up.

16. A machine method according to claim 15 wherein:

a. said retaining cover layer of said initial assembly is adhesively attached to said spacer layer; and b. said placing of said spacer layer on said circuit layer comprises adhesively bonding said circuit layer to said spacer layer.

17. A machine method for providing, for dome switches of the type wherein each dome switch comprises an approximately hemispherical top surface having an apex, a complete dome switch assembly having a circuit layer, a retaining cover layer, a spacer layer having a plurality of openings for respectively receiving a plurality of dome switches, a release liner, and an overlay layer, comprising the steps of:

a. positioning on a machine table having a machine-movable surface an initial assembly comprising i. said circuit layer, circuit side upwards, and ii. adjacent said circuit side of said circuit layer, said spacer layer, having a spacer layer top surface;

b. situating said dome switches, affixed in a dome switch input reel, over said machine-movable surface of said machine table;

c. machine-blanking respective said dome switches from said dome switch input reel so that said dome switches drop into respective said openings of said spacer layer;

d. placing said retaining cover layer, having a retaining cover top surface, on said spacer layer top surface; and e. placing said overlay layer, having an icon side, with said icon side upwards, on said retaining cover top surface;

f. thereby making a complete dome switch assembly;

g. wherein said machine-movable surface is structured and arranged for lateral movement in orthogonal directions.

18. A machine method according to claim 17 wherein:

a. each substep of said machine-blanking step comprises i. moving said machine-movable table in such manner that said machine-movable table locates for machine dome switch placement an unfilled said opening not having therein a said dome switch; and ii. machine-blanking a said dome switch in such manner as to allow said dome switch to drop into said unfilled opening; and b. said dome switch input reel is structured and arranged in such manner that when said dome switches are blanked, said dome switches drop into said spacer layer openings with said apex of said dome switch facing up.

19. A machine method according to claim 18 wherein:

a. said retaining cover layer of said initial assembly is adhesively attached to said spacer layer; and b. said placing of said spacer layer on said circuit layer comprises adhesively bonding said circuit layer to said spacer layer.

20. A machine method for providing, for dome switches of the type wherein each dome switch comprises an approximately hemispherical top surface having an apex, a dome switch sub-assembly having a retaining cover layer, a spacer layer having a plurality of openings for respectively receiving a plurality of dome switches, and a release liner, comprising the steps of:

a. positioning on a machine table having a machine-movable surface an initial assembly comprising i. said retaining cover layer, having a retaining cover top surface, and ii. adjacent said retaining cover top surface, said spacer layer, having a spacer layer top surface;

b. machine-blanking respective said dome switches from said dome switch input reel so that said dome switches drop into respective said openings of said spacer layer; and c. placing said release liner on said spacer layer top surface;

d. wherein said machine-movable surface is structured and arranged for lateral movement in orthogonal directions.

* * * * *